US009725285B2

(12) United States Patent
Willim

(10) Patent No.: US 9,725,285 B2
(45) Date of Patent: Aug. 8, 2017

(54) METHOD OF RAISING A CRANE BOOM

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 1346 days.

(21) Appl. No.: 12/290,248

(22) Filed: Oct. 29, 2008

(65) Prior Publication Data

US 2009/0134108 A1 May 28, 2009

(30) Foreign Application Priority Data

Oct. 29, 2007 (DE) ..... 10 2007 051 539

(51) Int. Cl.
*B66C 23/82* (2006.01)
*B66C 23/34* (2006.01)

(52) U.S. Cl.
CPC ..... *B66C 23/82* (2013.01); *B66C 23/342* (2013.01)

(58) Field of Classification Search
None
See application file for complete search history.

(56) References Cited

U.S. PATENT DOCUMENTS

| | | | | |
|---|---|---|---|---|
| 3,028,018 A * | 4/1962 | Mott | 212/300 |
| 3,732,988 A * | 5/1973 | Lamer | 212/300 |
| 3,968,884 A | 7/1976 | Johnson et al. | |
| 4,473,214 A | 9/1984 | Sterner et al. | |
| 6,062,404 A * | 5/2000 | Erdmann | 212/292 |
| 2006/0065616 A1* | 3/2006 | Diehl | 212/300 |
| 2006/0096940 A1* | 5/2006 | Willim | 212/300 |

FOREIGN PATENT DOCUMENTS

| | | | |
|---|---|---|---|
| CN | 1767998 A | | 5/2006 |
| DE | 2552111 | | 6/1976 |
| DE | 2552111 A1 | | 6/1976 |
| DE | 20 2004 017 771 | | 3/2006 |
| JP | 1-92198 A | * | 4/1989 |
| JP | 9-67086 A | * | 3/1997 |
| JP | 10-194676 A | * | 7/1998 |
| JP | 2001-151469 A | * | 6/2001 |
| JP | 2001151469 A | | 6/2001 |
| SU | 519386 A | * | 7/1976 |
| SU | 969650 A | * | 10/1982 |
| SU | 969650 A1 | | 10/1982 |

OTHER PUBLICATIONS

Machine Translation for Oishi JP 1998-194,676 (JP 10-194,676).*
Machine Translation for Ishihara JP 2001-151,469.*
English Abstract for Okada JP 01092198.*

* cited by examiner

*Primary Examiner* — Sang Kim
*Assistant Examiner* — Juan Campos, Jr.
(74) *Attorney, Agent, or Firm* — Dilworth & Barrese, LLP

(57) ABSTRACT

The invention relates to a method of raising a telescopic boom of a mobile crane having a luffing fly jib and having a spatial boom guying. To be able to raise particularly long luffing fly jib systems together with the telescopic boom here, in accordance with the invention the telescopic boom is first telescoped outwardly to its desired length. In this position, all the telescopic sections are bolted to one another and the spatial guying is tensioned before the raising of the luffing fly jib pivotally connected to the telescopic boom.

22 Claims, 5 Drawing Sheets d)
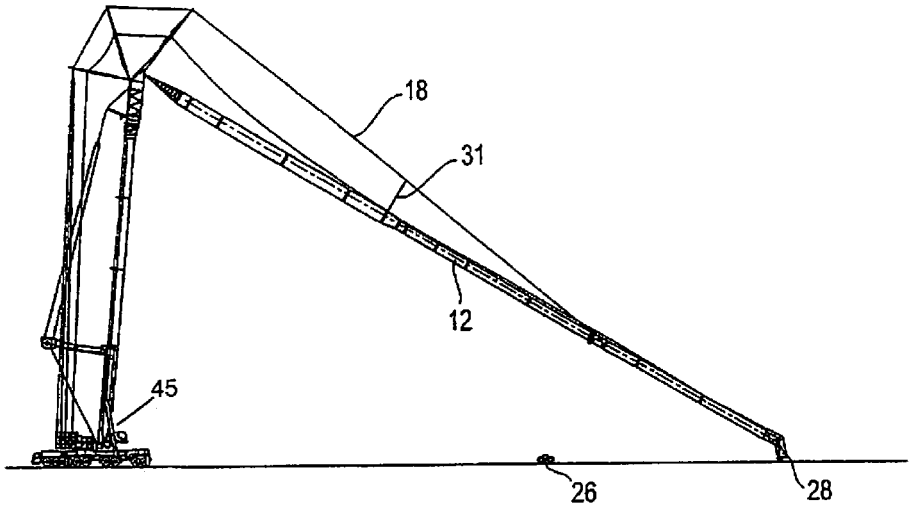
e)
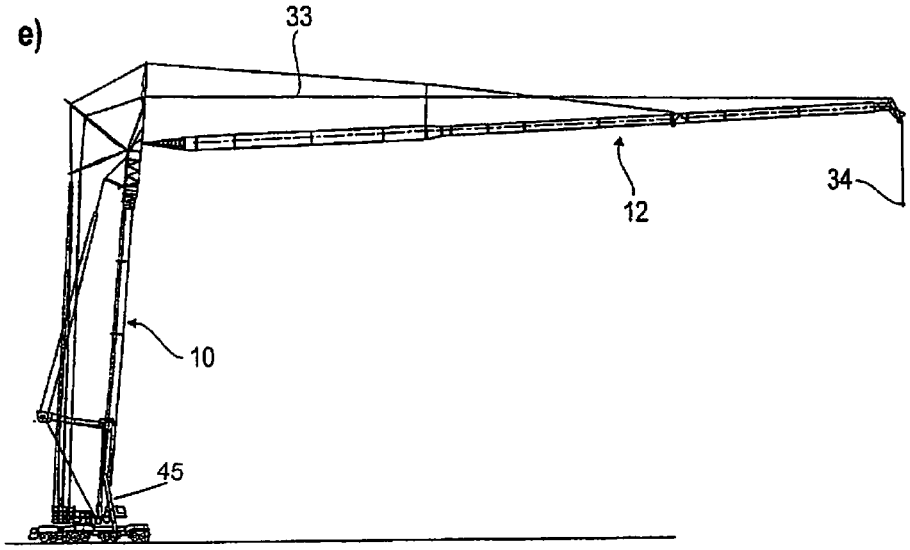

METHOD OF RAISING A CRANE BOOM

BACKGROUND OF THE INVENTION

The invention relates to a method of raising a telescopic boom of a mobile crane having a luffing fly jib and having spatial boom guying.

Very high lifting heights and radii are frequently required. They go beyond the ranges of telescopic cranes. Luffing fly jibs are also mounted on the telescopic boom in such cases due to possible projecting edges. The luffing fly jibs can have very large lengths in this respect which can even project far beyond the length of the main boom itself.

With high projecting edges, lifting heights of up to 170 m are reached. Spatial guying at the telescopic boom is used for stabilization as a rule with such long boom systems. An eccentric fastening of the guying to the main boom tip has already become known from DE 20 2004 017 771 U1 which is likewise used in systems having such high lifting heights.

Large telescopic cranes are currently frequently designed so that they can be operated with spatial guying. They thus only reach the highest load torques with tensioned spatial guying in certain operating positions (for example, with a steep raising of the main boom). This operating position is actually frequently encountered on the use of a boom system having a main boom with a fitted luffing fly jib. The total stability of the main boom is greatly reduced without the tensioned spatial guying. It must be observed here that the spatial guying only extends over the main boom and an optionally present main boom extension. The luffing fly jib is in contrast held in the luffing plane by stay poles and optionally, with a special length, by additional intermediate guying means.

A corresponding crane boom according to the prior art is shown in FIG. 1. It has a telescopic boom 10 having a fitted luffing fly jib 12 (only shown schematically here). A guy rope 16 pivotally connected to the so-called raising trestles 14 as well as stay poles 18 which brace the luffing fly jib 12 and are connected to one of the raising trestles 14 at one end and to the free end 20 of the luffing fly jib 12 at the other end serve the luffing. So-called Y guying 22 is additionally provided which serves the spatial guying of the telescopic boom 10. Such a crane boom in accordance with the prior art is raised as follows:

1. First, the boom 10 and the spatial guying 22 are installed ready for operation, but naturally not tensioned. The telescopic boom 10 has not yet been extended to operating length.

2. Subsequently, the luffing fly jib is installed and is provided with at least one carriage so that it can travel on the ground.

3. Subsequently, the luffing fly jib 12 is connected to the almost horizontally positioned main boom 10. A possible main boom extension or an adapter such as are not shown in the representation in accordance with FIG. 1 is considered part of the main boom in the present description since it is fixedly connected to the main boom at the topmost telescopic section.

4. The inwardly telescoped main boom 10 is raised into a steep position, with the outer end of the luffing fly jib lying on the carriage at the base. For this purpose, the luffing fly jib can pivot around the pivotal connection points at the main boom 10.

5. Subsequently, the luffing fly jib is raised and set up in a steep position. The torque caused by the luffing fly jib is kept low by the steep positioning and the support friction in the telescope is advantageously reduced. At this time, however, the outer end of the boom system is free and has no form of support. The total guidance of the long boom system is provided by the main boom 10.

6. The main boom is then telescoped outwardly to the desired length. For this purpose, the boom section to be telescoped is in each case bolted to the telescopic cylinder.

7. After the expulsion, the bolting of the respective telescopic sections takes place, with the connection of the expulsion cylinder to the telescopic sections being released.

8. Finally, the spatial guying 22 is tensioned. The boom system now reaches its maximum working load.

9. In the raising method in accordance with the prior art, the weight of the total boom system bears on the telescopic cylinder and thus on the piston rod. The kinking forces acting on the piston rod and the torques acting on the support of the piston rod are highly relevant here. On the other hand, the total boom system has to be guided between the foot support and the head support of the telescope A to be expelled. The spacing of the two support points with respect to one another is reduced by the expulsion procedure, whereby an increasing support friction and thus higher telescopic cylinder forces occur.

It must furthermore be taken into account that at the end of the expulsion procedure the telescopic part 1 is expelled and this allows a relatively large side deformation of the boom system disposed above in the transverse direction to the boom in the non-bolted state. The total stability in the lateral direction is hereby no longer completely ensured. Due to the high lateral boom deformation, the loads on the pivotal connection piece and on the telescopic piece 1 become too high under certain circumstances.

The load on the boom system is the highest at step 5. Here, the maximum permitted lengths of the boom system, specifically those of the luffing fly jib, are limited by the forces and torques occurring in this installation procedure.

SUMMARY OF THE INVENTION

It is therefore the object of the invention to provide a method of raising a crane boom which is further developed such that comparatively larger boom systems can be installed.

In accordance with the invention, the object is solved by a method having the central raising steps herein. The previously known method is now modified in accordance with the invention such that the telescopic boom is first telescoped outwardly to its desired length, that all the telescopic sections are bolted to one another in this position and that the spatial guying is tensioned before the luffing fly jib pivotally connected to the telescopic boom is raised. The telescopic boom serving as the main boom in accordance with the invention is thus laterally substantially more stable due to the spatial guying before the luffing fly jib is raised. Overall, substantially longer luffing fly jibs can thereby be fitted since the telescopic boom can already take up substantially higher forces and torques during the raising of the luffing fly jib due to the spatial guying.

Preferred embodiments of the invention result from the description herein.

BRIEF DESCRIPTION OF THE DRAWINGS

Further details and advantages of the invention will be explained in more detail with reference to the embodiments shown in the drawing. There are shown.

DESCRIPTION OF THE PREFERRED EMBODIMENTS

Figure 1:
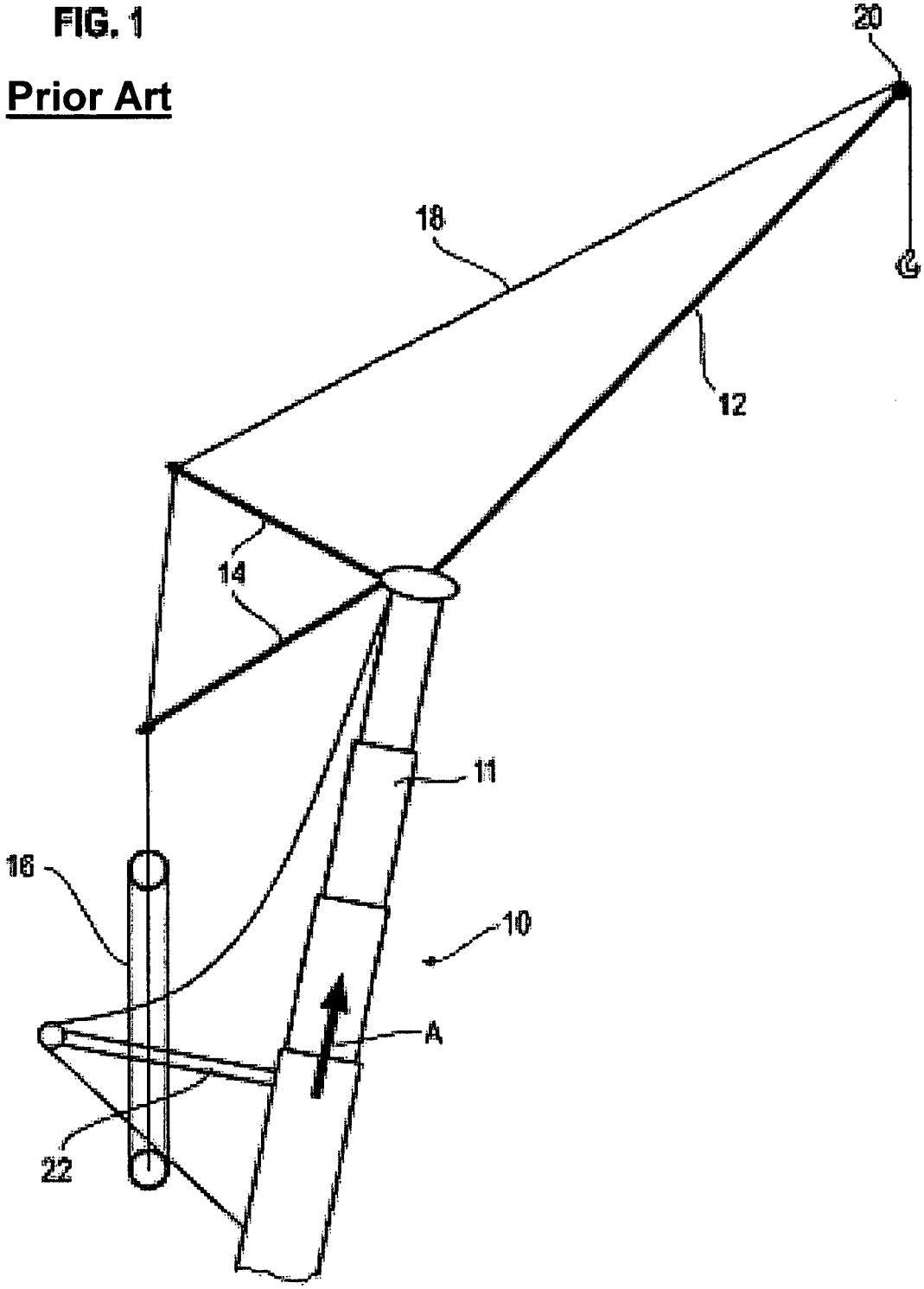
FIG. 1 Prior Art
FIG. 1: a schematic representation of a boom in accordance with the prior art.

The raising method in accordance with the invention will be described in the following with reference to FIGS. 2 and 3. First, as shown in FIG. 3*a*, the telescopic boom 10 is installed in an approximately horizontal position on the mobile crane 5. At the same time, the spatial guying 22 is raised, but not yet tensioned at this time. The telescopic boom 10 is completely retracted here. In the representation in accordance with FIG. 3, an adapter 24 which is counted as part of the main boom is additionally fixedly connected to the telescopic boom 10. Likewise still shown in FIG. 3*a*, a luffing fly jib 12 is installed and is supported on a carriage 26 or 28 respectively. The luffing fly jib 12 in FIG. 3 is made up of two parts which can be kinked around bolt points 30. The carriage 26 is arranged in the region of these bolt points. The carriage 28 is arranged at the outer end of the luffing fly jib. At the inner end, the luffing fly jib is connected via bolt connections 32 to the adapter 24 of the main boom.

Subsequently, in accordance with the representation according to FIG. 3*b*, the telescopic boom 10 is positioned steeply together with the adapter 24 and, as shown in FIG. 3*c*, is telescoped outwardly to the desired length. The telescopic boom 10 is raised by means of a luffing cylinder 45. During the steep positioning and outward telescoping, the luffing fly jib 12 is pulled up at the pivotally connected end, while the kink point and the free outer end of the luffing fly jib 12 roll off along the ground on the carriage 26 or 28 respectively. This can all be seen clearly from the representations 3*b* and 3*c*. The stay poles 18 of the luffing fly jib 12 are shown in FIG. 3*c*. Intermediate guying 31 is additionally shown here. Once the last telescopic section 11 has been extended and bolted, the spatial guying 22 is tensioned. The boom system hereby achieves its maximum stability, in particular also in the transverse direction of the longitudinal boom axis. At this time, the hoist rope 33 is not yet tensioned.

It is now shown in FIGS. 3*d* and 3*e* how the luffing fly jib 12 is raised. During the raising, the luffing fly jib 12 is first lifted from the carriage 26 (cf. FIG. 3*d*) while the free outer end of the luffing fly jib 12 still rolls off on the carriage 28. Subsequently, the free end is also pulled up accordingly. The hoist rope 33 is also tensioned over the hook block 34 in FIG. 3*e*.

Figure 2:
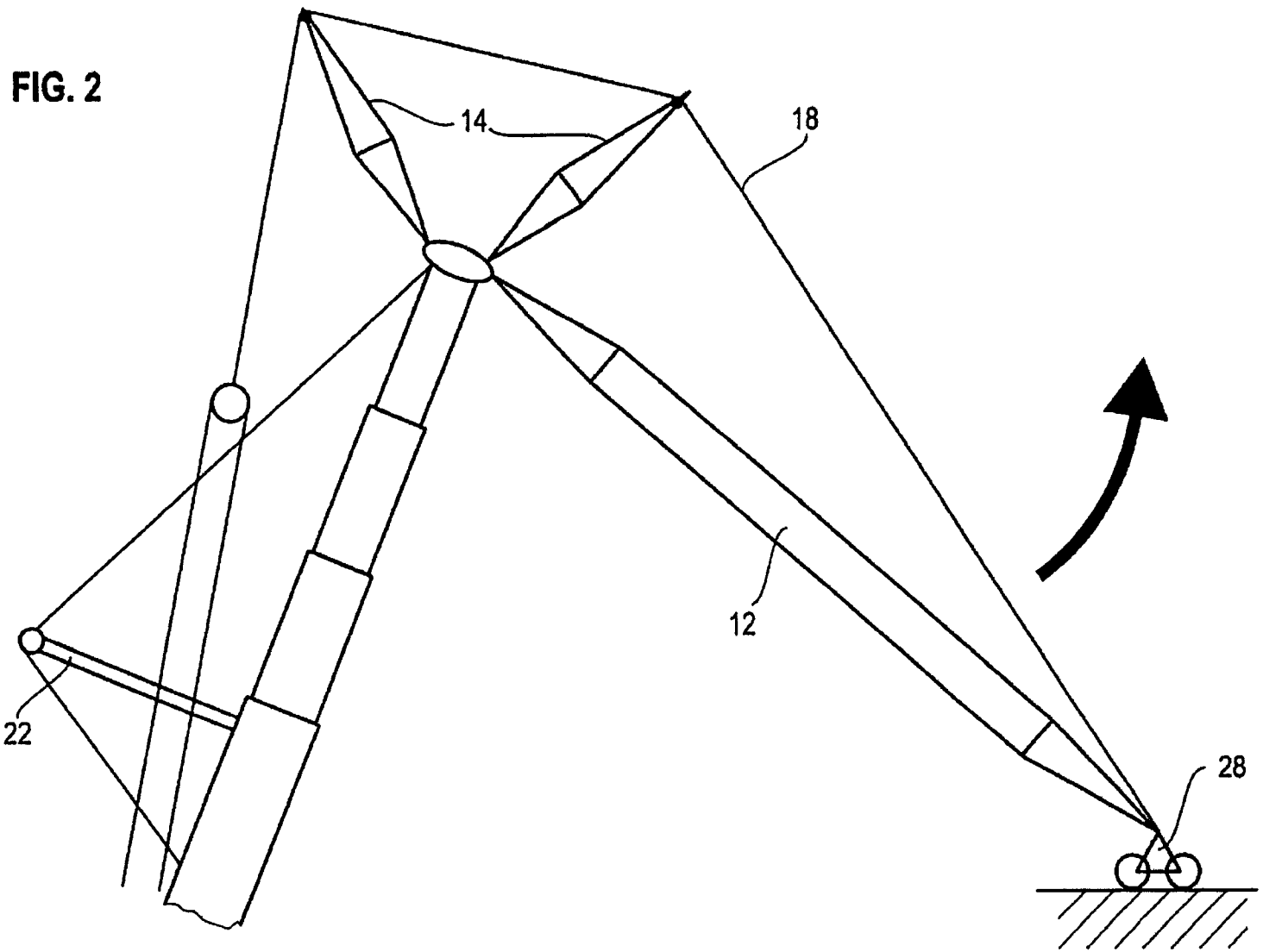
FIG. 2: a schematic representation of a boom to illustrate the method in accordance with the invention.
Figure 3:
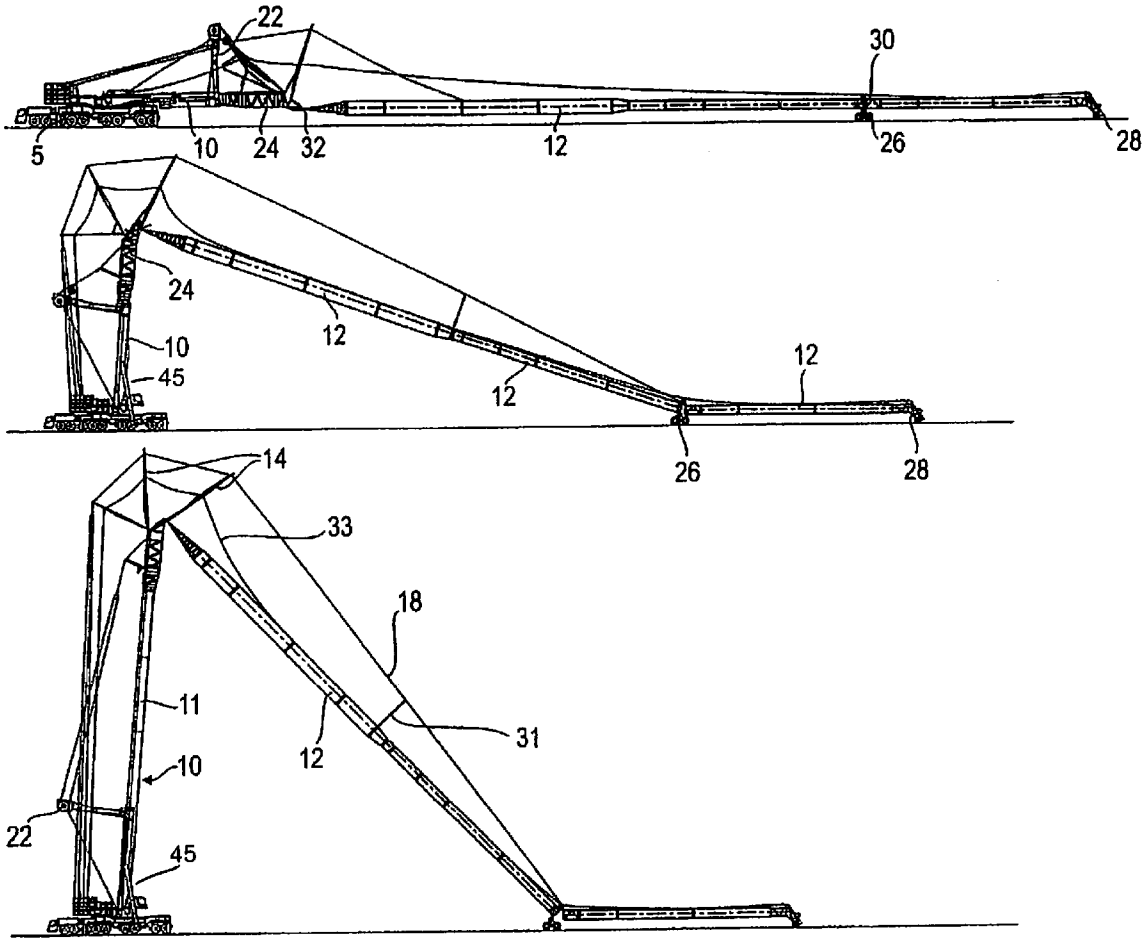
FIGS. 3*a*-3*e*: a mobile crane with a telescopic boom in different installation positions.

The representation in accordance with FIG. 2 substantially corresponds to that in accordance with FIG. 3. Here, the luffing fly jib is, however, only made in one part and is therefore only supported on one carriage 28. However, it also again becomes clear from FIG. 2 that the spatial guying 22 is tensioned before the raising of the luffing fly jib 12.

Figure 4:
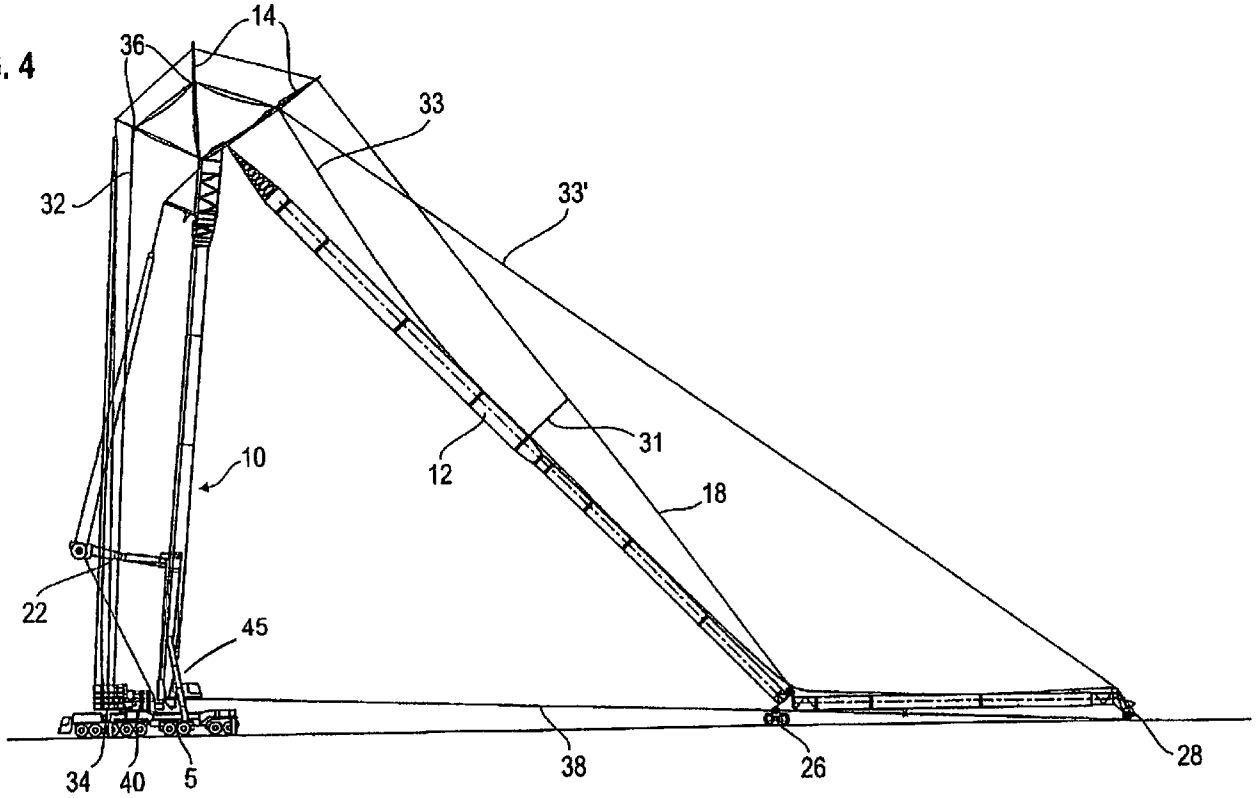
FIG. 4: a mobile crane with a telescopic boom in which the hoist rope is tensioned with an auxiliary rope during installation.

FIG. 4 shows a mobile crane 5 which has a similar structure to that in accordance with FIG. 3. In FIG. 4, the hoist rope is shown at 32 which is now no longer sheared into a hook block and held under tension by it in the new raising method of the boom. There is now a balance of forces in the raised telescopic boom 10.

The weight of the part of the hoist rope above the main boom pulls the hoist rope in the direction of the hoist rope winch 34. The weight of the other part of the hoist rope 33 above the luffing fly jib 12 pulls the hoist rope away from the winch 34. There is a balance in this respect. However, on the outward telescoping of the telescopic boom 10, this balance is impaired. It could be disrupted in this respect. As soon as the part of the hoist rope above the tip boom 12 now becomes shorter than the part above the telescopic boom 10, the hoist rope 33 is retracted in an accelerated manner. Once the end of the hoist rope 33 has reached a pulley block 36 of the guying trestle 14, it falls in free fall in the direction of the crane. This risk is precluded in accordance with the solution shown in FIG. 4 in that an auxiliary rope 38 is connected to the hoist rope 33'. The hoist rope 33' is thereby held tautly in the embodiment shown in FIG. 4. The hoist rope 33 in FIG. 4, which is drawn as slack here, therefore only serves for explanation. The auxiliary rope 38 is loaded with a defined tension via an auxiliary winch 40 which is arranged at the superstructure of the mobile crane 5. The tension is limited by a relief valve and the auxiliary rope 38 can be unwound from the auxiliary winch 40. The performance of the auxiliary winch drive is selected so that it can only wind up the auxiliary rope at an appropriate speed. After the raising of the luffing fly jib, the auxiliary rope is released again since the hook block 34 tensions the hoist rope 33' in this state again.

The invention claimed is:

1. A method of raising a telescopic boom of a mobile crane having a luffing fly jib and having spatial boom guying, wherein the telescopic boom includes telescoping sections and is first telescoped outwardly to a desired length of the telescopic boom, all the telescopic sections are bolted to one another in this position and the spatial boom guying is tensioned before the luffing fly jib pivotally connected to the telescopic boom is raised, wherein the spatial boom guying is Y-shaped guying connected to the telescopic boom and extending laterally outward therefrom out of a plane of the luffing movement.

2. A method in accordance with claim 1, wherein the telescopic boom is installed together with the spatial boom guying, ready for operation, but not tensioned, in an approximately horizontal position before the outward telescoping.

3. A method in accordance with claim 2, wherein the luffing fly jib is pivotably bolted to the telescopic boom in almost horizontal position and movably supported on at least a first carriage at a free end of an outer part of the luffing fly jib.

4. A method in accordance with claim 3, wherein the main boom is positioned steeply and telescoped outwardly to a desired position so that the pivotally connected first end of the luffing fly jib is raised and an outer end of the luffing fly jib rolls freely on the first carriage.

5. A method in accordance with claim 4, wherein the luffing fly jib is made in multiple parts, with a kinking of the parts with respect to one another being made possible in a region of a connection point of the luffing fly jib parts.

6. A method in accordance with claim 5, wherein a releasable second carriage is arranged in a region of the kink point of the luffing fly jib before the raising.

7. A method in accordance with claim 3, wherein the luffing fly jib is made in multiple parts, with a kinking of the parts with respect to one another being made possible in a region of a connection point of the luffing fly jib parts.

8. A method in accordance with claim 7, wherein a releasable second carriage is arranged in a region of the kink point of the luffing fly jib before the raising.

9. A method in accordance with claim 2, wherein the luffing fly jib is made in multiple parts, with a kinking of the parts with respect to one another being made possible in a region of a connection point of the luffing fly jib parts.

10. A method in accordance with claim 1, wherein the luffing fly jib is pivotably bolted to the telescopic boom in almost horizontal position, and movably supported on at least a first carriage at a free end of the outer part of the luffing fly jib.

11. A method in accordance with claim 10, wherein the main boom is positioned steeply and telescoped outwardly to a desired position so that the pivotally connected first end of the luffing fly jib is raised, and an outer part of the luffing fly jib rolls freely on the first carriage.

12. A method in accordance with claim 11, wherein the luffing fly jib is made in multiple parts, with a kinking of the parts with respect to one another being made possible in a region of a connection point of the luffing fly jib parts.

13. A method in accordance with claim 12, wherein a releasable second carriage is arranged in a region of the kink point of the luffing fly jib before the raising.

14. A method in accordance with claim 10, wherein the luffing fly jib is made in multiple parts, with a kinking of the parts at a kink point with respect to one another being made possible in a region of a connection point of the luffing fly jib parts.

15. A method in accordance with claim 14, wherein a releasable second carriage is arranged in a region of the kink point of the luffing fly jib before the raising.

16. A method in accordance with claim 10, wherein the luffing fly jib is made in multiple parts, with a kinking of the parts with respect to one another being made possible in a region of a connection point of the luffing fly jib parts.

17. A method in accordance with claim 16, wherein a releasable second carriage is arranged in a region of the kink point of the luffing fly jib before the raising.

18. A method in accordance with claim 1, wherein an auxiliary rope which runs off from an auxiliary winch and is loaded with a defined tension by the auxiliary winch, is connected to the hoist rope during the raising.

19. The method in accordance with claim 18 wherein the auxiliary winch is arranged on a superstructure of the mobile crane.

20. A method of raising a telescopic boom of a mobile crane having a luffing fly jib and having spatial boom guying, wherein the telescopic boom includes telescoping sections is first raised by means of a luffing cylinder and telescoped outwardly to a desired length of the telescopic boom, all the telescopic sections are bolted to one another in this position and the spatial boom guying is tensioned before the luffing fly jib pivotally connected to the telescopic boom is raised, wherein the spatial boom guying is Y-shaped guying out of a plane of the luffing movement.

21. A method in accordance with claim 20, wherein the luffing fly jib is pivotably bolted to the telescopic boom in almost horizontal position, and movably supported on at least a first carriage at a free end of the outer part of the luffing fly jib.

22. A method in accordance with claim 20, wherein the luffing fly jib includes an inner part and an outer part wherein a first end of the inner part is pivotably bolted to the telescopic boom in almost horizontal position and a second end of the inner part is pivotally connected to the outer part at a kink point, the outer part of the luffing fly jib is movably supported on at least a first carriage at a free end of the outer part of the luffing fly jib and the luffing fly jib is movably supported on a releasable second carriage in the vicinity of the kink point.

* * * * *